US005410803A

United States Patent [19]

Gerhard, Jr.

[11] Patent Number: 5,410,803

[45] Date of Patent: May 2, 1995

[54] FEED MECHANISM IN A TOOL FOR TERMINATING RIBBON CABLE TO A CONNECTOR

[75] Inventor: George H. Gerhard, Jr., Laureldale, Pa.

[73] Assignee: The Whitaker Corporation, Wilmington, Del.

[21] Appl. No.: 169,030

[22] Filed: Dec. 16, 1993

[51] Int. Cl.[6] ..... H01R 43/055; H01R 43/045

[52] U.S. Cl. ..... 29/753; 29/566.4; 29/751; 29/866

[58] Field of Search ..... 29/33 M, 566.3, 566.4, 29/749, 750, 751, 753, 759, 861, 863, 866; 72/410

[56] References Cited

U.S. PATENT DOCUMENTS

| | | | |
|---|---|---|---|
| 4,144,633 | 3/1979 | Tucci | 29/751 X |
| 4,178,675 | 12/1979 | Phillips | 29/759 X |
| 4,563,810 | 1/1986 | Aldon et al. | 29/753 X |
| 4,642,874 | 2/1987 | Litehizer, Jr. | 29/566.4 |

FOREIGN PATENT DOCUMENTS

| | | | |
|---|---|---|---|
| 3512157 | 10/1986 | Germany | 29/749 |

OTHER PUBLICATIONS

IS 9359-AMP Terminating Head 58336-1 For AMP-MODU MTE Connectors; Nov. 17, 1987 pp. 1-7.

*Primary Examiner*—Peter Dungba Vo

[57] ABSTRACT

A tool is disclosed for terminating conductors of a ribbon cable to insulation displacement contacts of terminals that are partially assembled to a connector housing. After termination of all of the terminals the assembly is removed from the tool and the entire strip of terminals is fully inserted into the connector housing and the carrier strip removed and discarded. The tool includes a terminal strip feed mechanism that is partially contained in the base of the tool that feeds both the strip of terminals and the ribbon cable so that it does not interfere with movement of the ribbon cable. The feed mechanism is coupled to the ram so that energy is stored during the termination stroke of the ram which is subsequently used during the return stroke to drive the feed mechanism in advancing the strip of terminals and ribbon cable into position for terminating the next conductor.

11 Claims, 6 Drawing Sheets

PRIOR ART
Fig. 1
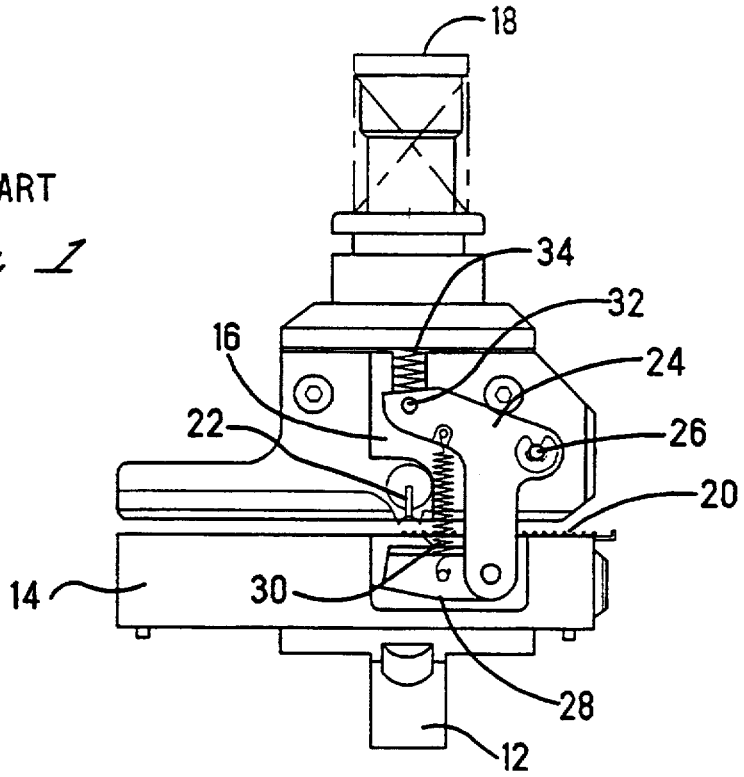
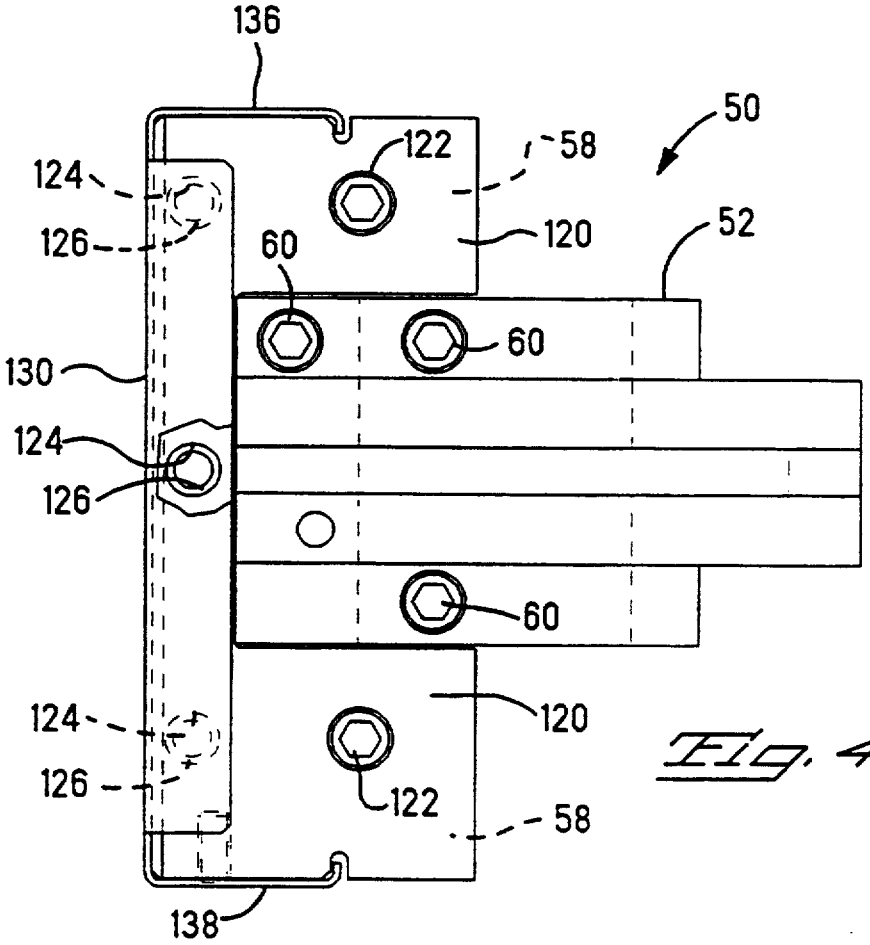
Fig. 4

FEED MECHANISM IN A TOOL FOR TERMINATING RIBBON CABLE TO A CONNECTOR

The present invention relates to tools for terminating the conductors of ribbon cable to the terminals of a connector and more particularly to a mechanism for feeding the terminals and associated conductors into an insertion station.

BACKGROUND OF THE INVENTION

There is a need for small hand operated or simple bench mounted tools that may be efficiently used to terminate conductors to terminals of a connector on a small quantity basis. One such terminating tool is the Terminating Head part number 58336-1, manufactured by AMP Incorporated, Harrisburg Pa. The tool is arranged to be attached to a standard pistol grip handle for manual actuation, an air powered handle, or may be mounted to a work bench along with an air power unit for power actuation. The tool, a front view of which is shown in FIG. 1 and identified as 10, is limited to terminating discrete wires only. As is shown, the tool 10 includes a frame 12, a terminal strip guide 14, and an insertion mechanism 16 which is driven by a ram 18. A connector having a strip 20 of terminals partially assembled thereto is positioned within the frame so that the strip of terminals rests on a work surface of the guide 14 and the left most terminal is in alignment with the insertion blade. A discrete wire is inserted from the front of the tool into a U-shaped opening 22 so that it is between the insertion blade and the first terminal. The ram 18 is then caused to move downwardly, as viewed in FIG. 1, causing the wire to be pushed into the insulation displacement contact of the first terminal. A somewhat L-shaped feed arm 24 is pivotally attached to the frame 12 by means of a pivot pin 26. A feed finger 28 is pivotally attached to and carried by the arm 24 and is spring biased toward the strip of terminals by the spring 30. A pin 32 extends from the upper portion of the arm 24 into a vertically disposed slot in the ram 18. A spring 34 arranged between the frame 12 and the pin 32, pushes the pin 32 against the bottom of the slot. When the tool is actuated the ram 18 moves downwardly and the spring 34 urges the pin 32 to follow and remain in engagement with the bottom of the slot. This pivots the arm 24 counterclockwise so that the feed finger moves toward the right causing the points of the feed fingers to cam out of the drive holes in the carrier strip, ride along the bottom of the strip, then engage the next set of drive holes. When the termination is complete the ram moves upwardly with the pin 32 still against the bottom of the slot, thereby forcing the arm 24 to pivot clockwise, moving the feed finger to the left which feeds the strip of terminals to the left one position, ready for the next termination.

The tool 10 is an excellent tool for terminating discrete wires, however, does not lend itself easily to modification so that it will accommodate ribbon cable. To accomplish this purpose the feed arm 24 must be replaced with an entirely new structure that does not block front access to the work surface by the ribbon cable. What is needed is a terminal strip feeding mechanism that is coupled to and actuated by the ram that will not interfere with movement of the ribbon cable across the work surface of the tool.

SUMMARY OF THE INVENTION

A tool is disclosed for attaching individual conductors of a ribbon cable to respective terminals of a strip of terminals of an electrical connector. The tool includes a frame, a work surface within the frame, and a ram arranged to undergo reciprocating motion along an axis within the frame toward and away from the work surface to effect termination of the conductors to the terminals. A track is arranged for guiding and positioning each of the terminals of the connector in seriatim into insertion position on the work surface in alignment with the axis. Feed means is provided and associated with the ram for advancing the strip of terminals and the conductors in a direction of feed. The feed means is arranged so that with each downward stroke of the ram one of the terminals has been previously moved into the insertion position along with the conductor to be terminated thereto, and with each upstroke of the ram the one terminal and terminated conductor are moved away from the insertion position and an adjacent terminal and conductor to be terminated thereto, if any, are moved in the direction of the feed into insertion position.

DESCRIPTION OF THE FIGURES

FIG. 1 is a front view of a prior art tool for terminating discrete wires to terminals of a connector;

FIG. 4 is a bottom view of the tool shown in FIG. 2;

DESCRIPTION OF THE PREFERRED EMBODIMENT

Figure 2:
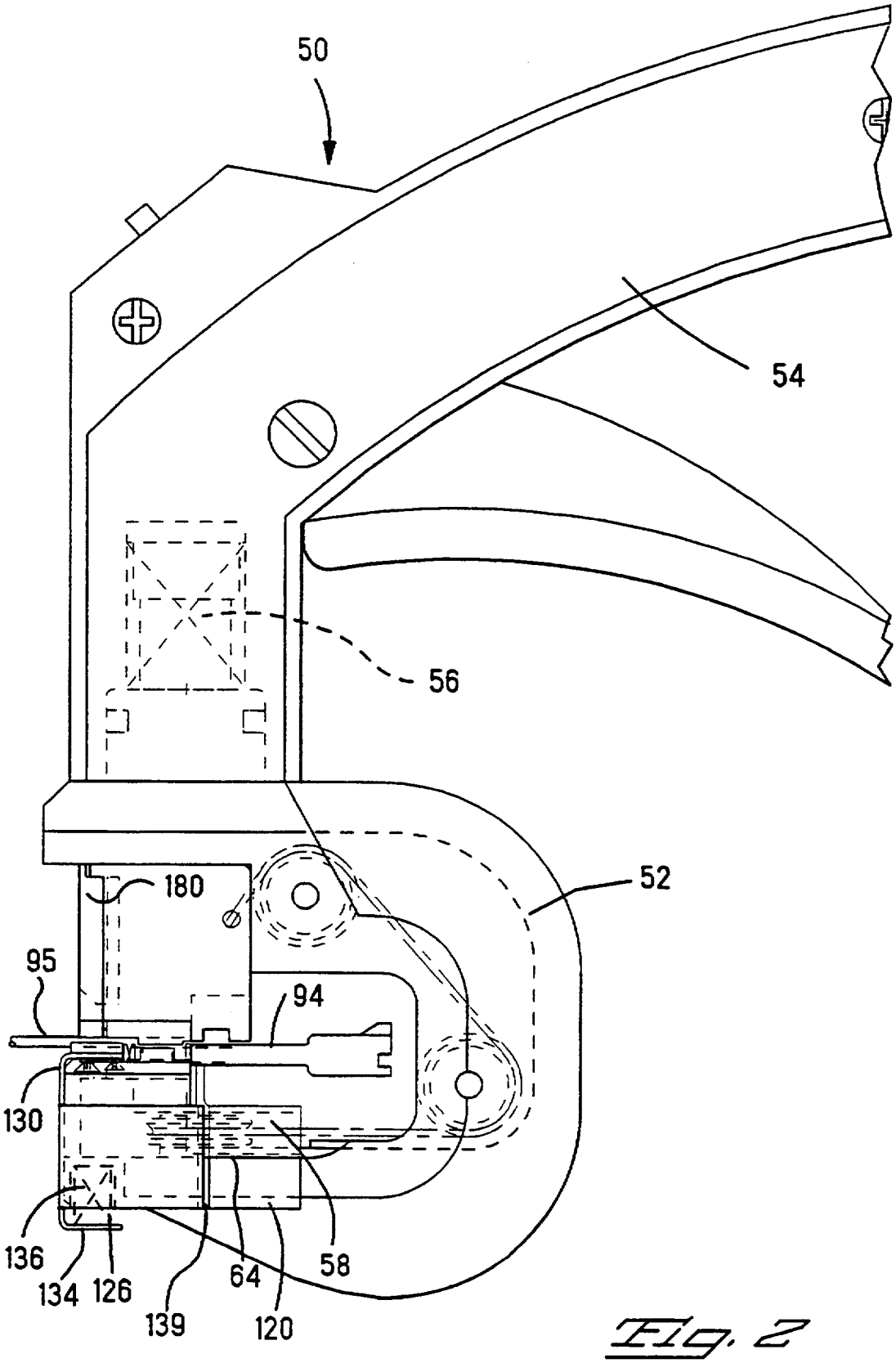
FIG. 2 is a side view of a tool for terminating conductors of a ribbon cable to terminals of a connector, incorporating the teachings of the present invention.
Figure 3:
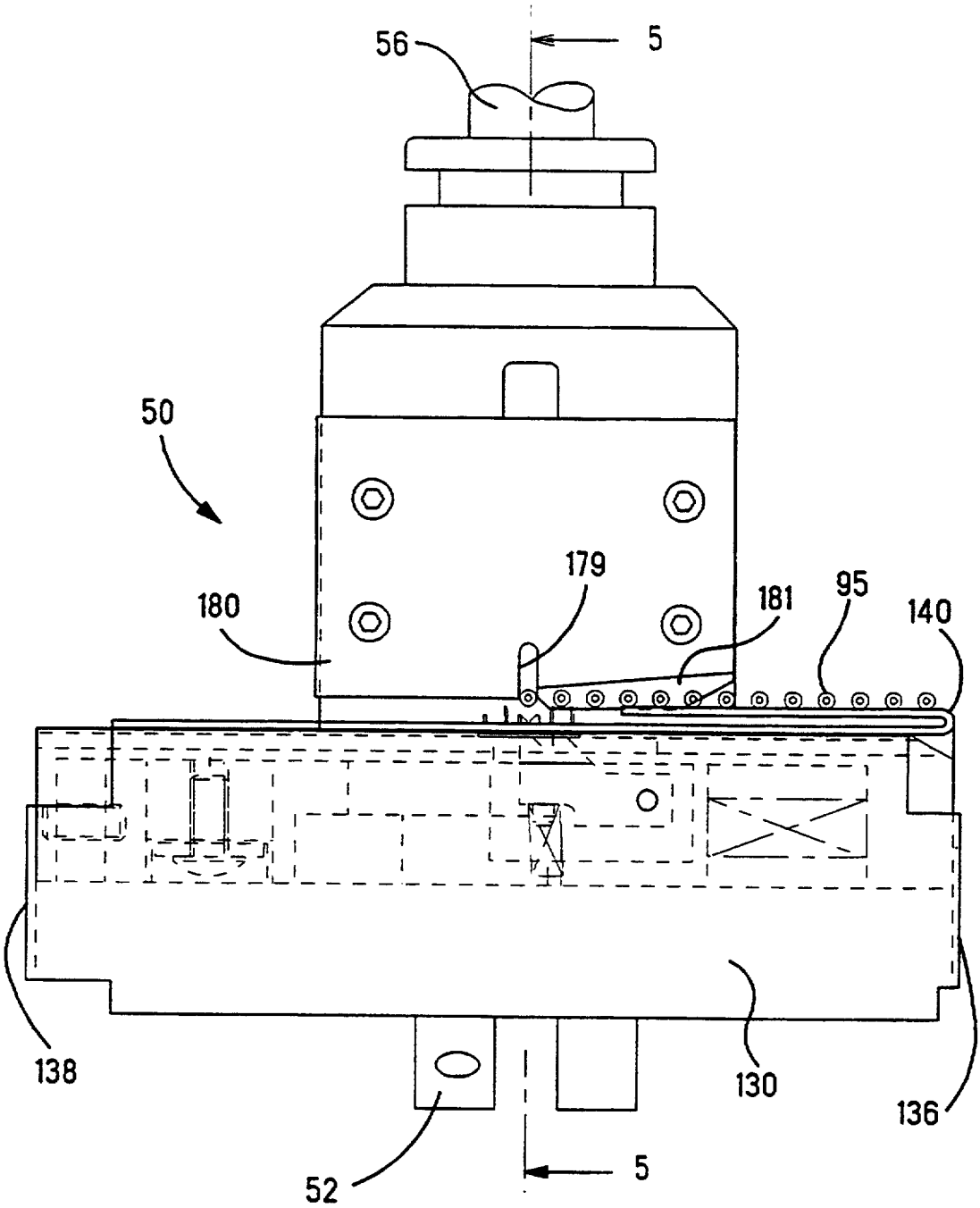
FIG. 3 is a front view of the tool shown in FIG. 2.
Figure 5:
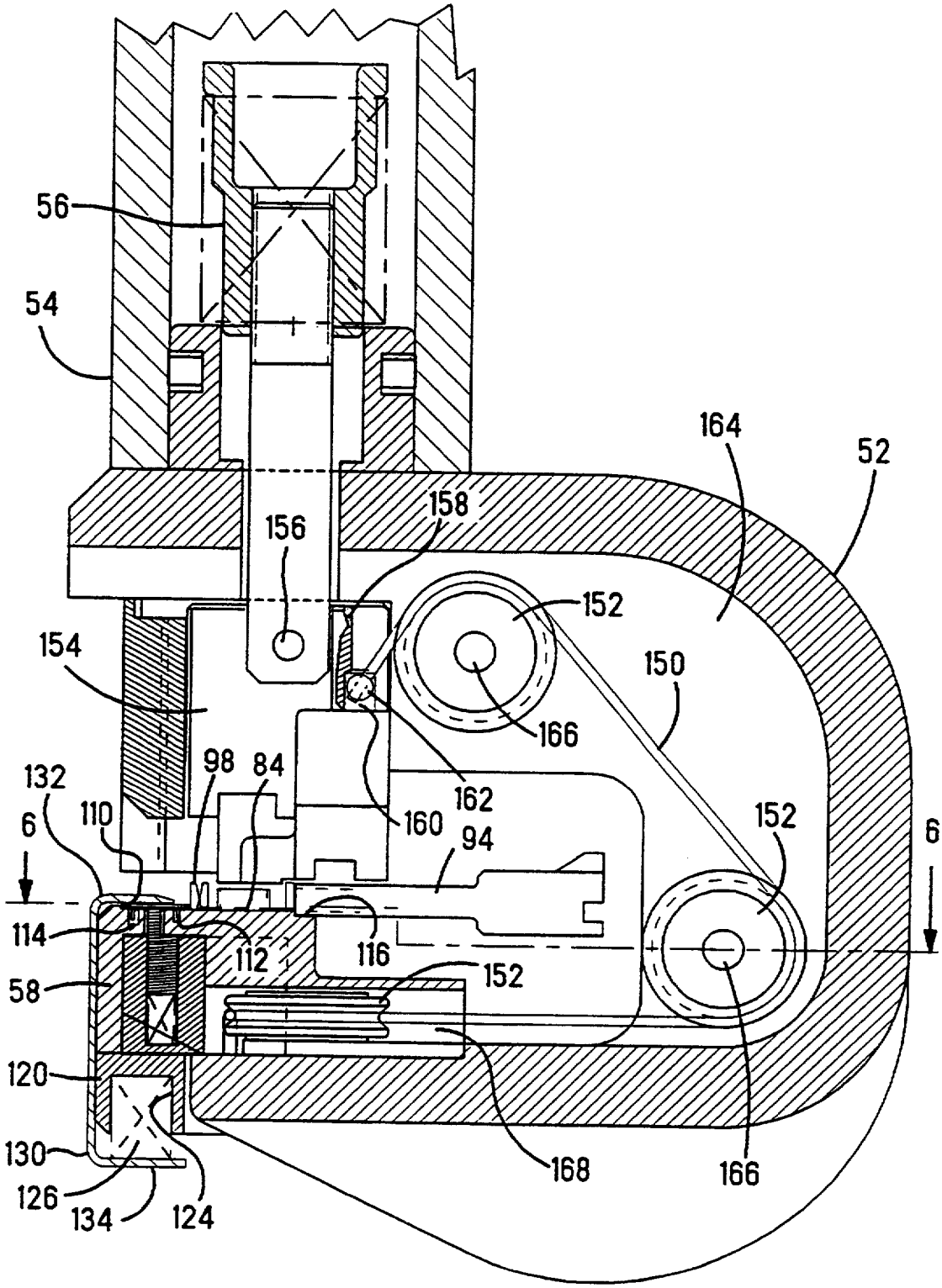
FIG. 5 is a cross-sectional view taken along the lines 5—5 of FIG. 3.
Figure 6:
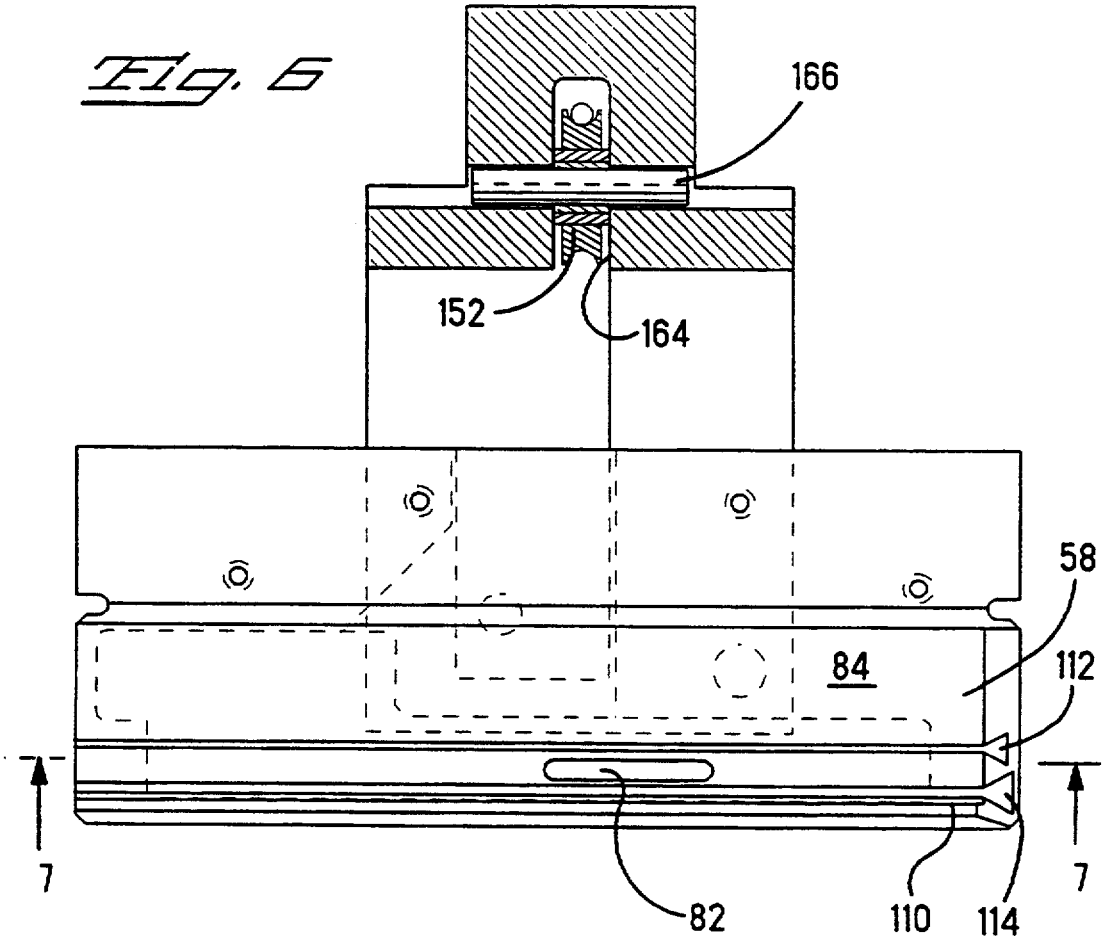
FIG. 6 a cross-sectional view taken along the lines 6—6 of FIG. 5.
Figure 7:
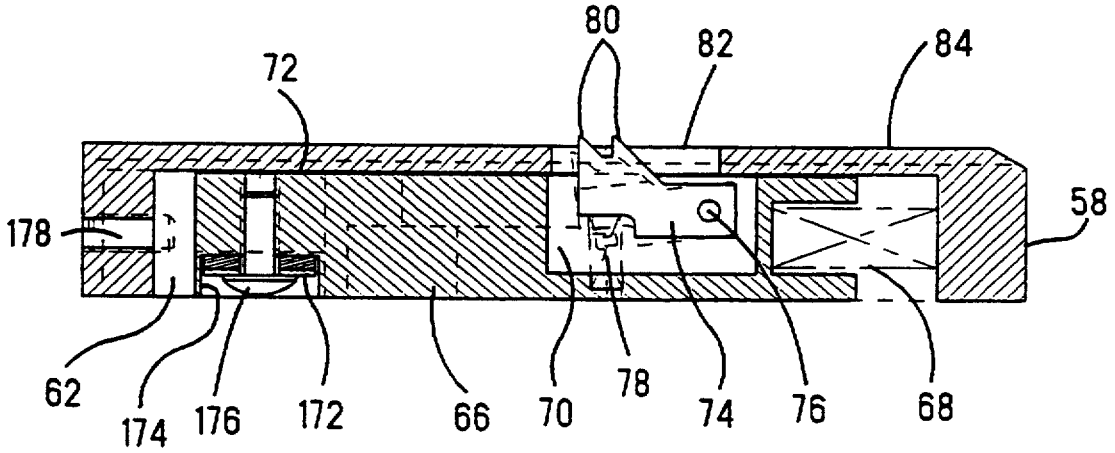
FIG. 7 is a cross-sectional view taken along the lines 7—7 of FIG. 6.
Figure 8:
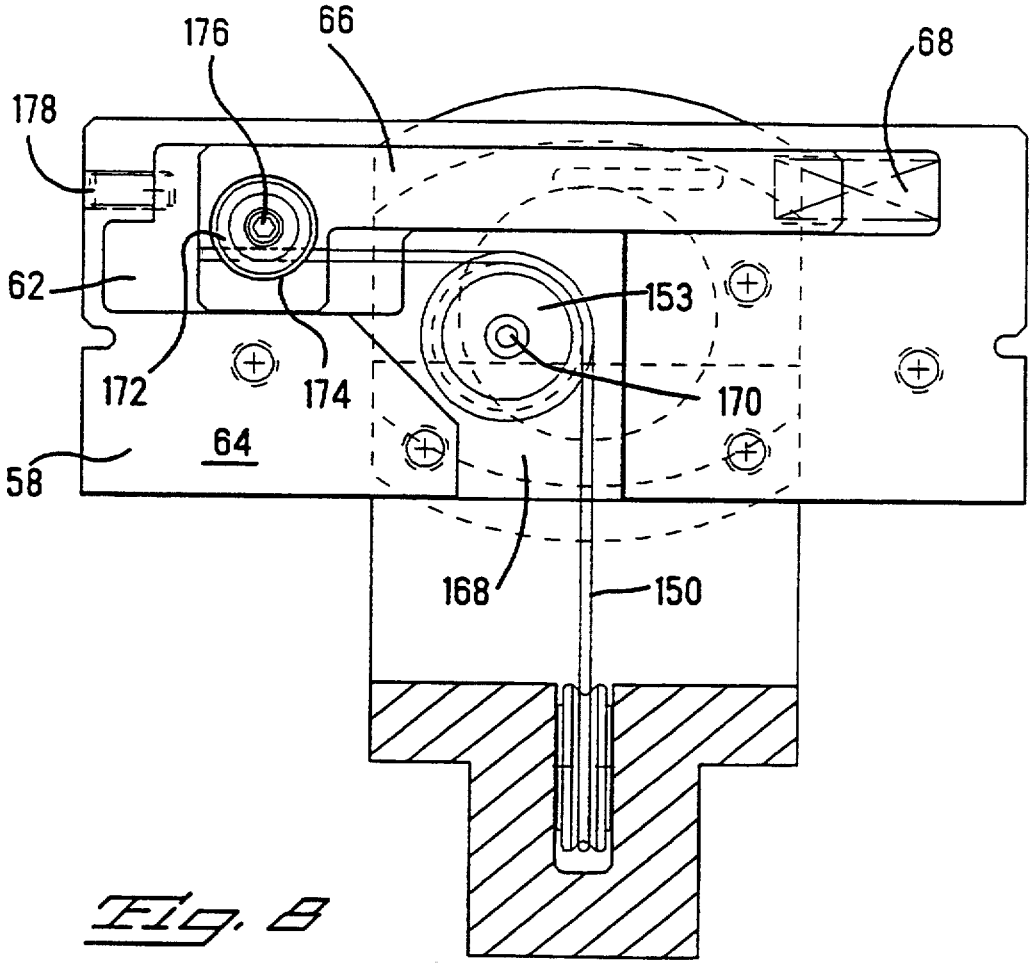
FIG. 8 is a view similar to that of FIG. 4 with the slide cover late removed and a portion of the frame cut away.

There is shown in FIGS. 2, 3, and 4 a tool 50 having a frame 52 and, as best seen in FIG. 2, a pistol grip handle 54 for manual actuation of a ram 56. A base plate 58 is attached to the frame by means of three screws 60 that are threaded into holes in the base plate. As shown in FIGS. 5, 7, and 8, the base plate 58 has a first recess 62 formed in its bottom surface 64 that is arranged to accommodate a slide 66. The slide 66 is a slip fit within the recess 62 and is free to slide along a horizontal path, as viewed in FIG. 8. A compression spring 68 is arranged in a guide hole in the end of the slide and pushes against the end of the recess 62 to urge the slide toward the left, as viewed in FIGS. 3, 7, and 8. The slide 66 includes an opening 70 in its upwardly facing surface 72, as seen in FIG. 7, containing a feed finger 74 that is pivotally attached to the slide by means of a pin 76. A compression spring 78 urges the feed finger to pivot clockwise so that a pair of feed points 80 extend above the surface 72. The base plate 58 includes an elongated opening 82, as seen in FIGS. 6 and 7, in alignment with the opening 70 so that the feed finger projects into this opening with the feed points 80 extending a slight amount above a work surface 84 of the plate 58.

Figure 9:
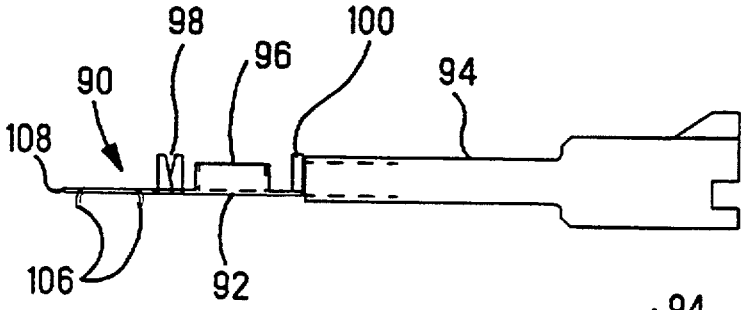
FIG. 9 is a side view of a typical connector of the type that is terminated in the resent tool.
Figure 10:
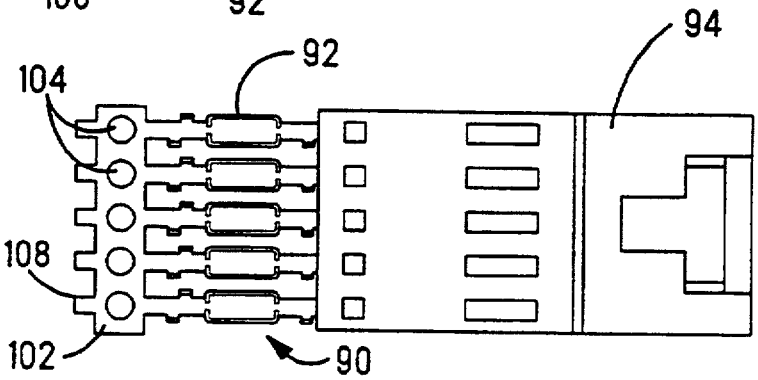
FIG. 10 is a plan view of a portion of the connector shown in FIG. 9.

The work surface 84 of the base late 58 is arranged to receive and guide a strip 90 of terminals 92 and associated connector housing 94, which are shown in FIGS. 9 and 10. A ribbon cable 95 is shown in position to be terminated to the terminals 92. As shown in FIGS. 9 and 10, each terminal 92 includes an insulation displacement contact box 96, a pair of upwardly facing lugs 98 that are to be crimped about the insulated portion of the conductor being terminated in the contact box 96, and another upwardly facing lug 100 that serves to prevent inadvertent insertion of the terminals into the housing prior to termination. Each of the terminals 92 is attached, at one end, to a carrier strip 102 having a series of equally spaced pilot holes 104 formed therein. The pilot holes 104 are spaced center to center a distance that is identical to that of the terminals 92. The carrier strip 102 has two rows 106 of downwardly facing tabs extending therefrom and a locating edge 108 along one side. The base plate 58, as best seen in FIGS. 5 and 6, has a shoulder 110 rising from the work surface 84 a slight amount for the length of the work surface. A pair of slots 112 and 114 are formed in the work surface parallel with the shoulder 110 and with the direction of motion of the slide 66 and spaced part an amount corresponding to the spacing of the two rows 106 of tabs. The strip 90 is placed on the work surface 84 so that the locating edge 108 is in locating engagement with the shoulder 110 and the rows 106 of tabs are in the slots 112, 114. The tabs in the slots 112 limit movement of the strip away from the shoulder 110. A rabbet 116 and a cutout 118, as shown in FIG. 5, are formed in the work surface 84 to provide clearance for the connector housing 94. There is sufficient clearance to accommodate housings of varying size and shape.

A U-shaped slide Support plate 120 is attached to the bottom of the base plate 66 with two screws 122, as best seen in FIG. 4, that are threaded into the base plate, thereby retaining the slide 66 within the first recess 62. Three spaced blind holes 124 are disposed in the bottom surface of the plate 120, each of which has a compression spring 126 therein. A terminal strip drag 130 having a U-shaped cross section is arranged so that one leg 132 is directly above the carrier strip 102 and the other leg 134 is under a portion of the plate 120 so that the springs 126 push against the leg 134 thereby causing the leg 132 to urge the carrier strip lightly against the strip 90 of terminals on the work surface 84. The drag 130 is held in place by means of a pair of flanges 136 and 138 which extend from the two ends of the drag, along the sides of the plates 58 and 120, and then turn inwardly toward each other to engage a pair of slots 139 formed in the sides of the plates, as best seen in FIG. 4. The two flanges 136 and 138 are spaced to allow the drag to easily slide vertically, as viewed in FIGS. 2 and 3, while the slots 139 hold the drag captive to the tool 50 and help to maintain the leg 132 parallel with the work surface 84, as viewed in FIG. 5. By manually depressing the leg 134 to compress the spring 126, the other leg 132 is raised above the work surface 84 a sufficient amount so that the carrier strip 102 can be slid into place on the work surface and against the shoulder 110. The leg 134 is then released and the spring 126 urges the drag 130 downwardly against the carrier strip 102 to provide resistance to movement of the strip 90 of terminals during operation of the tool 50. The drag 130 includes a raised surface 140 which, in the resent example, is simply a continuation of the leg 132 that is folded back on itself 180 degrees and extends to the opening 82 but not over it, as shown in FIG. 3. This raised surface 140 is spaced above the work surface 84 a small amount and is arranged to receive and guide the ribbon cable 95 and to space the ribbon cable from the strip 90 of terminals until just prior to actual termination of each the conductors, as will be explained below. Alternatively, the raised surface 140 can be provided by attaching a block of appropriate thickness to the top surface of the leg 132.

The slide 66 is made to move rightwardly against the bias of the compression spring 68, as viewed in FIG. 8, as the ram moves toward the work surface 84 by means of a relatively thin cable 150, or other flexible member. The cable 150 is indirectly coupled to the ram 56 and directly coupled to the slide 66 and is routed around a pair of pulleys 152 and a pulley 153, all of which are journaled for rotation within the frame 52. As is best seen in FIG. 5, an insertion bar 154 is coupled to the ram 56 by means of a pin 156 so that as the ram reciprocates within the frame 52 the insertion bar 154 moves toward and away from the work surface 84. An ear 158 extends from one side of the insertion bar 154 toward a pulley 152. A hole 160 is bored part way into the bottom of the ear 158 and the end slotted through to the hole, as shown in FIG. 5. This forms a nest for capturing a ball 162 that is crimped to the end of the cable 150. As the ram 56 and insertion bar 154 are made to move downwardly toward the work surface 84, the ball 162 and associated end of the cable 150 are pulled along. The two pulleys 152 are arranged with their axes perpendicular to the path of reciprocation of the ram 56. These pulleys are disposed within an opening 164 in the frame 52, as shown in FIGS. 5 and 6. Each of the pulleys 152 includes a bearing and inner race. A pair of roll pins 166 are inserted into respective through holes formed in the frame 52 and through the inner races of their respective pulleys 152. The pulley 153 is identical to the pulleys 152 but is mounted to a raised surface 167 on the frame 52 within a second recess 168 formed in the bottom surface of the support plate 58 adjacent the first recess 62. A roll pin 170 is inserted through the race of the pulley 153 and pressed into a hole in the raised surface 167 providing cantilevered support for the pulley. The axis of the pulley 153 is parallel with the path of reciprocation of the ram 56. The cable 150 is adjustably anchored to the slide 66 with a clamp block 172 that is positioned within a shallow recess 174 in the bottom surface of the slide 66, as best seen in FIGS. 7 and 8. The clamp block 172 is clamped against the bottom of the recess with the cable 150 sandwiched therebetween, by a screw 176 that is threaded into the slide 66. This permits some adjustment of the cable to control cable tension. A set screw 178 is threaded into the end of the base plate 58 so that it extends into the first recess adjacent the end of the slide 66, as shown in FIGS. 7 and 8. This set screw is used to adjust the limit of travel of the slide 66 in the direction of feed.

In operation, the leg 134 is manually depressed compressing the spring 126, the other leg 132 is thereby raised above the work surface 84 and a carrier strip 102 slid into place on the work surface under the leg 132 and against the shoulder 110. The leg 134 is then released so that the spring 126 urges the drag 130 downwardly against the carrier strip 102 to hold the strip 90 of terminals in place and to provide resistance to movement of the strip during operation of the tool 50. The strip 90 is manually pushed along the locating shoulder 110 until the strip engages the feed points 80 of the feed finger 74 causing the feed finger to deflect downwardly against the force of the compression spring 78 until the holes 104 of the carrier strip are in alignment with the feed points. At this point the feed points enter the holes 104 allowing the feed finger to quickly pivot upwardly to its starting position, as shown in FIG. 7, emitting an audible snapping sound. After the audible sound the operator then advances the first terminal 92 forward one additional position by cycling the ram 56 to place the terminal in proper position under the insertion bar 154. A prepared ribbon cable 95 is positioned on the raised surface 140, as shown in FIG. 3, with its left most insulated conductor against an edge 179 of a wire stop plate 180 so that the conductor is directly between the first terminal 92 and the insertion bar 154. The edge 179 is the left edge of a vertically disposed U-shaped slot formed in the stop plate. The sheared end of the ribbon cable is urged against a rear stop surface 181 which serves to position the conductors axially as well as orient the ribbon cable perpendicular to the direction of feed. Note that the end of the ribbon cable was previously prepared by notching the insulation between the conductors so that each conductor end is separated from the others yet is surrounded by a layer of insulation. The notching process is well known in the industry.

The ram 56 is then caused to move toward the work surface 84 by manually actuating the pistol grip handle 54, or the power actuator if utilized. As the ram 56 and attached insertion bar 154 move toward the work surface 84, as viewed in FIGS. 7 and 8, the ball 162 and attached cable 150 are pulled along, thereby causing the slide 66 to move toward the right compressing the spring 68 thereby storing energy from the moving ram 56. During this movement of the slide 66 the feed points 80 cam downwardly out of the holes 104 and ride along the under surface of the carrier strip 102 then snap into the next set of holes 104 as the ram 56 nears the bottom of its stroke. As the ram 56 reaches the bottom of its stroke the slide has moved an additional amount, about 0.050 inch in the resent example, the insertion bar 154 has inserted the first conductor in the first insulation displacement contact box 96, crimped the lugs 98 about the insulated conductor, and folded over the tab 100. The additional movement of the slide 66 causes the feed points 80 to just begin to cam out of their holes 104 in the carrier strip 102. This provides 0.050 inch of lost motion in the feed mechanism when the ram is reciprocated upwardly on the return stroke. During the return stroke the cable 150 is allowed to follow the movement of the slide 66 toward the left under the urging of the spring 68, as viewed in FIG. 3. As the return stroke begins the insertion bar 154 first withdraws from the terminated terminal 92 and, when clear, the lost motion of the feed mechanism is expended and the feed finger, utilizing the stored energy in the spring 68, now carries the strip 90 of terminals and the now attached ribbon cable toward the left, as viewed in FIG. 3, until the next terminal 92 and conductor are in aligned position under the insertion bar 154. The ram 56 is again reciprocated toward and away from the work surface until all of the conductors to be terminated are terminated to their respective terminals 92. The cable 95 and attached connector are then removed from the tool 50 by sliding them in the direction of feed until they are clear. The assembly is then visually examined to assure proper terminations. The strip of terminals is then fully inserted into the connector housing and the carrier strip broken off and discarded. While the tool 50, in the present example, is shown to terminate the conductors of ribbon cable to the terminals of a partially assembled connector, it can also be utilized to terminate discrete wires to these terminals. In this case the strip 90 of terminals and attached connector housing 94 are loaded into the tool 50 as set forth above. The first wire is then inserted into the U-shaped slot in the stop plate 180 so that its end is against the rear stop surface 181. The tool is then cycled to terminate the conductor and advance the strip 90 so that the next terminal is in position under the insertion bar 154. Each discrete wire is terminated in this way until all wires are terminated.

An important advantage of the present invention is that the feed mechanism is simple and inexpensive to make and, most importantly, is effective in feeding both the strip of terminals with attached connector housing and the ribbon cable without interfering with the movement of the ribbon cable. Additionally, the tool is effective for terminating the conductors of both ribbon cable and discrete wires.

I claim:

1. In a tool for attaching individual conductor of a ribbon cable to respective terminals of a strip of terminals of an electrical connector wherein said tool includes a frame, a work surface within said frame, a ram arranged to undergo reciprocating motion along an axis within said frame toward and away from said work surface to effect termination of said conductors to said terminals, a track for guiding and positioning each of said terminals of said connector in seriatim into insertion position on said work surface in alignment with said axis, feed means associated with said ram for advancing strip of terminals and said conductors in a direction of feed so that with each downward stroke of said ram one of said terminals which has been previously moved into said insertion position along with one of said conductors to be terminated thereto is terminated, and with each upstroke of said ram said one terminal and said one conductor are moved away from said insertion position and another of said terminals and another of said conductors to be terminated thereto are automatically moved in said direction of said feed into said insertion position, wherein said feed means includes means actuated by said ram for receiving and storing energy provided by said ram only when said ram is moving toward said work surface, releases stored energy to effect said feeding of said strip of terminals and conductors only when said ram is moving away from said work surface.

2. The tool according to claim 1 wherein said feed means includes a slide member arranged to move in a first direction parallel with said direction of said feed and in an opposite second direction, and a feed finger coupled to said slide member arranged to engage said strip of terminals and move them when said slide member is moved in said first direction and to not move said strip of terminals when said slide member is moved in said second direction.

3. The tool according to claim 2 wherein said energy storage means is a spring arranged to urge said slide member in said first direction.

4. The tool according to claim 2 including coupling means coupled to said ram and to said slide member for effecting said movement of said slide member in said ram toward said work surface.

5. The tool according to claim 4 wherein said coupling means includes a flexible member having one end coupled to said ram and the other end attached to said slide member so that when said ram moves toward said work surface said flexible member pulls said slide member in said second direction.

6. The tool according to claim 5 wherein said flexible member is a cable and said coupling means includes a plurality of pulleys journaled in said frame and arranged in engagement with said cable.

7. The tool according to claim 1 including a plate attached to said frame, said work surface being a surface of said plate disposed perpendicular to said axis of said ram, and said track being a raised lip extending perpendicular to and away from said work surface and a slot in said work surface spaced from and parallel with said raised lip, said lip and said slot adapted to receive and guide said strip of terminals.

8. The tool according to claim 7 wherein said feed means includes a slide member disposed within an opening in said plate and arranged to move in a first direction parallel with said direction of said feed and in an opposite second direction, and a feed finger coupled to said slide member and extending through another opening in said plate that intersects said work surface, said feed finger arranged to engage said strip of terminals and move them when said slide member is moved in said first direction and to not move said strip of terminals when said slide member is moved in said second direction.

9. The tool according to claim 8 including coupling means for effecting said movement of said slide member in said second direction in response to and by movement of said ram toward said work surface, wherein said coupling means includes flexible member having one end attached to said ram and the other end attached to said slide member so that when said ram moves toward said work surface said flexible member pulls said slide member in said second direction.

10. The tool according to claim 9 wherein said coupling means includes a pulley journaled in said frame so that its axis of rotation is perpendicular to said axis of said ram and a pulley journaled for rotation in said plate so that its axis of rotation is perpendicular to said work surface, and wherein said flexible member is a cable in operational engagement with said two pulleys, said cable having one end attached to said ram and the other end attached to said slide member.

11. The tool according to claim 10 including a raised surface spaced from said work surface for receiving and guiding said ribbon cable during said advancing thereof.

* * * * *

UNITED STATES PATENT AND TRADEMARK OFFICE

CERTIFICATE OF CORRECTION

PATENT NO. : 5,410,803

DATED : May 2, 1995

INVENTOR(S) : George H. Gerhard, Jr.

It is certified that error appears in the above-identified patent and that said Letters Patent is hereby corrected as shown below:

Column 6, line 26,

Claim 1, line 1, delete "conductor" and replace with --conductors--

Line 39,

Claim 1, line 13, insert --said-- before "strip"

line 53,

Claim 1, line 27, insert --and wherein said means for receiving and storing energy -- before "releases"

Column 8, line 11,

Claim 9, line 5, insert --a-- before "flexible"

Signed and Sealed this

Twenty-seventh Day of June, 1995

*Attest:*

*Attesting Officer*

BRUCE LEHMAN

*Commissioner of Patents and Trademarks*